US009220296B2

(12) United States Patent
Fall et al.

(10) Patent No.: US 9,220,296 B2
(45) Date of Patent: Dec. 29, 2015

(54) METHOD OF REDUCING TOBACCO-SPECIFIC NITROSAMINES

(71) Applicants: Safall Fall, Changé (FR); Nathalie Durot, Le Mans (FR); Solen Prime, Le Mans (FR); Francois-Marie Robin, Spay (FR)

(72) Inventors: Safall Fall, Changé (FR); Nathalie Durot, Le Mans (FR); Solen Prime, Le Mans (FR); Francois-Marie Robin, Spay (FR)

( * ) Notice: Subject to any disclaimer, the term of this patent is extended or adjusted under 35 U.S.C. 154(b) by 0 days.

(21) Appl. No.: 14/212,257

(22) Filed: Mar. 14, 2014

(65) Prior Publication Data

US 2014/0261482 A1 Sep. 18, 2014

Related U.S. Application Data

(60) Provisional application No. 61/786,831, filed on Mar. 15, 2013.

(51) Int. Cl.

| | |
|---|---|
| ***A24B 15/12*** | (2006.01) |
| ***A24B 15/24*** | (2006.01) |
| ***A24B 15/42*** | (2006.01) |

(52) U.S. Cl.

CPC ..... *A24B 15/245* (2013.01); *A24B 15/42* (2013.01)

(58) Field of Classification Search

USPC ..... 131/290, 297

See application file for complete search history.

(56) References Cited

U.S. PATENT DOCUMENTS

| | | | | |
|---|---|---|---|---|
| 3,353,541 | A | | 11/1967 | Hind et al. |
| 3,386,449 | A | | 6/1968 | Hind |
| 3,415,253 | A | | 12/1968 | Michels et al. |
| 3,420,241 | A | | 1/1969 | Hind et al. |
| 3,428,053 | A | | 2/1969 | Schoenbaum et al. |
| 3,467,109 | A | | 9/1969 | Block et al. |
| 3,483,874 | A | | 12/1969 | Hind |
| 3,561,451 | A | | 2/1971 | Jacin et al. |
| 3,646,943 | A | * | 3/1972 | Blewitt et al. ..... 131/370 |
| 3,760,815 | A | | 9/1973 | Deszyck |

(Continued)

FOREIGN PATENT DOCUMENTS

| | | |
|---|---|---|
| EP | 0740907 | 6/1996 |
| EP | 1782702 | 5/2007 |

(Continued)

OTHER PUBLICATIONS

International Search Report for PCT/US01/31066, Apr. 2002.

(Continued)

*Primary Examiner* — Dennis Cordray

(74) *Attorney, Agent, or Firm* — Dority & Manning, P.A.

(57) ABSTRACT

A method for reducing the tobacco specific nitrosamines (TSNAs) in tobacco and tobacco smoke is provided. The tobacco is combined with a solvent to form a soluble extracts fraction and an insoluble residue fraction. The soluble extracts fraction is contacted with a nitrosamine-reducing material to provide a soluble extracts fraction having a reduced level of TSNAs. The nitrosamine-reducing material may comprise a sepiolite. The insoluble residue fraction is contacted with an alkali extractant to provide an insoluble residue fraction having a reduced level of TSNAs. The alkali extractant may comprise a hydroxide. The soluble extracts fraction having a reduced level of TSNAs and insoluble residue fraction having a reduced level of TSNAs may be recombined to form a reconstituted tobacco product having a reduced level of TSNAs. The TSNAs may be reduced by at least about 30%, such as at least about 40%, such as at least about 50%.

32 Claims, 3 Drawing Sheets

(56) References Cited

U.S. PATENT DOCUMENTS

| | | | |
|---|---|---|---|
| 3,805,803 | A | 4/1974 | Hedge et al. |
| 3,847,164 | A | 11/1974 | Mattina et al. |
| 3,860,012 | A | 1/1975 | Selke |
| 4,182,349 | A | 1/1980 | Selke |
| 4,256,123 | A | 3/1981 | Lendvay et al. |
| 4,256,126 | A | 3/1981 | Seligman et al. |
| 4,674,519 | A | 6/1987 | Keritsis et al. |
| 4,716,911 | A | 1/1988 | Poulose et al. |
| 4,730,629 | A | 3/1988 | Graves, Jr. et al. |
| 4,966,169 | A | 10/1990 | Waddell et al. |
| 5,016,655 | A | 5/1991 | Waddell et al. |
| 5,119,835 | A | 6/1992 | Heemann et al. |
| 5,137,034 | A | 8/1992 | Perfetti et al. |
| 5,148,819 | A | 9/1992 | Fagg |
| 5,230,354 | A | 7/1993 | Smith et al. |
| 5,234,008 | A | 8/1993 | Fagg |
| 5,243,999 | A | 9/1993 | Smith |
| 5,311,886 | A | 5/1994 | De Grandpré et al. |
| 5,575,302 | A | 11/1996 | Blöcker et al. |
| 5,584,989 | A | 12/1996 | Jameson |
| 5,601,097 | A | 2/1997 | De Grandpré et al. |
| 5,715,844 | A | 2/1998 | Young et al. |
| 5,724,998 | A | 3/1998 | Gellatly et al. |
| 5,765,570 | A | 6/1998 | Litzinger et al. |
| 5,810,020 | A | 9/1998 | Northway et al. |
| 5,829,453 | A | 11/1998 | White et al. |
| 6,058,940 | A | 5/2000 | Lane |
| 6,298,859 | B1 | 10/2001 | Kierulff et al. |
| 6,508,254 | B1 | 1/2003 | Mua et al. |
| 6,679,270 | B2 | 1/2004 | Baskevitch et al. |
| 6,772,767 | B2 | 8/2004 | Mua et al. |
| 8,151,806 | B2 | 4/2012 | Wanna |
| 2002/0134394 | A1 | 9/2002 | Baskevitch et al. |
| 2002/0148478 | A1 | 10/2002 | Pera |
| 2005/0263161 | A1 | 12/2005 | Mua |
| 2011/0000497 | A1 | 1/2011 | Wanna |
| 2011/0005534 | A1* | 1/2011 | Albino et al. ..... 131/270 |
| 2011/0108043 | A1* | 5/2011 | Ettireddy et al. ..... 131/274 |
| 2014/0224265 | A1 | 8/2014 | Rouillard et al. |
| 2014/0295049 | A1 | 10/2014 | Ragot et al. |

FOREIGN PATENT DOCUMENTS

| | | |
|---|---|---|
| EP | 2011408 | 1/2009 |
| GB | 1484663 | 9/1977 |
| WO | WO 9938396 | 8/1999 |
| WO | WO 0165954 | 9/2001 |
| WO | WO 0228209 | 4/2002 |
| WO | WO 2004021809 | 3/2004 |
| WO | WO 2004107885 | 12/2004 |
| WO | WO 2008090477 | 7/2008 |
| WO | WO 2012160133 | 11/2012 |

OTHER PUBLICATIONS

EP Search Report for EP 0197464, Aug. 2004.

W.M. Meier, Significant reduction of carcinogenic compounds in tobacco smoke by the use of zeolite catalysts, Microporous and Mesoporous Materials, pp. 307-310, Aug. 16, 1999.

International Search Report and Written Opinion for PCT/IB2014/059838, dated Mar. 20, 2015.

* cited by examiner

METHOD OF REDUCING TOBACCO-SPECIFIC NITROSAMINES

RELATED APPLICATIONS

This application is based on and claims priority to U.S. patent application Ser. No. 61/786,831, filed on Mar. 15, 2013, which is incorporated herein by reference in its entirety.

BACKGROUND

Smoking articles, (e.g., cigarettes, cigars, pipes, etc.), smokeless tobacco products (e.g., chewing tobacco, snuff, snus, etc.), and heat-not-burn products are made from natural tobacco, reconstituted tobacco, and blends thereof. Reconstituted tobacco is a type of tobacco that is generally manufactured from natural tobacco by-products generated during the threshing of the natural tobacco leaf or during the manufacture of the tobacco article. However, some natural tobaccos, such as dark air cured, air cured, burley tobaccos, etc., may contain nitrosamines formed during the curing of tobacco, e.g., tobacco-specific nitrosamines (TSNAs) and non-tobacco-specific nitrosamines. Likewise, reconstituted tobacco formed from natural tobacco by-products may also contain nitrosamines.

Unfortunately, these nitrosamines can be found in natural tobacco, reconstituted tobacco, tobacco extracts, tobacco fibers, smoke and/or aerosol. The presence of these TSNAs may raise health concerns for users repeatedly exposed to such constituents and other harmful components. As an example, the mainstream smoke produced by these tobacco products may itself contain nitrosamines, which are either transferred from tobacco or pyro-synthesized in certain cases. As another example, smokeless tobacco products may contain these nitrosamines as well. As a result, there is a need for reducing the content of TSNAs in tobacco products among which also include reconstituted tobacco products.

Many attempts have been made in the past to reduce certain components or constituents that may be contained in the mainstream smoke. Extensive research has been conducted on nitrosamines and TSNAs, particularly in tobacco products. As such, in many cases, it has been determined that such ingredients may be unwanted in the final tobacco product. For example, U.S. Pat. No. 5,810,020 to Northway, et al. describes a process for removing TSNAs from tobacco by contacting the tobacco material with a trapping sink, wherein the trapping sink comprises a select transition metal complex which is readily nitrosated to form a nitrosyl complex with little kinetic or thermodynamic hindrance.

Despite such attempted benefits to remove TSNAs from tobacco, a need currently exists for an improved method of reducing the content of nitrosamines (e.g., TSNAs) in tobacco, in particular reconstituted tobacco. In particular, a need exists for reducing the content of nitrosamines in tobacco to a greater extent than prior attempts. Additionally, a need exists for an effective and relatively inexpensive method for reducing nitrosamines in tobacco (e.g., natural tobacco, reconstituted tobacco, tobacco extracts, tobacco fibers, blends thereof, and other tobacco-containing materials) as well as tobacco products formed therefrom.

SUMMARY

The present disclosure is generally directed to a method of reducing tobacco-specific nitrosamines (TSNAs). In particular, according to the present disclosure, the tobacco-specific nitrosamines may be selected from the group consisting of N'-Nitrosonornicotine (NNN), 4-(Methylnitrosamino)-1-(3-pyridyl)-1-butanone (NNK), N'-Nitrosoanatabine (NAT), and N'-Nitrosoanabasine (NAB).

In general, according to the present disclosure, the method includes combining tobacco having an initial level of tobacco-specific nitrosamines with an aqueous solvent (e.g., water and/or other compounds) to form a soluble extracts fraction and an insoluble residue fraction. The soluble extracts fraction and insoluble residue fraction may also contain an initial total level of tobacco-specific nitrosamines.

Once formed, the soluble extracts fraction may be contacted with a nitrosamine-reducing material (e.g., adsorbent or absorbent) to provide a soluble extracts fraction having a reduced level of tobacco-specific nitrosamines. When compared to the initial level of tobacco-specific nitrosamines in the soluble extracts fraction, the tobacco-specific nitrosamines may be reduced in the soluble extracts fraction by at least about 5%, such as at least about 10%, such as at least about 20%, such as at least about 30%, such as at least about 40%, such as at least about 50%, such as at least about 55%.

Once formed, the insoluble residue fraction may be contacted with an alkali extractant to provide an insoluble residue fraction having a reduced level of tobacco-specific nitrosamines. When compared to the initial level of tobacco-specific nitrosamines in the insoluble residue fraction, the tobacco-specific nitrosamines may be reduced in the insoluble residue fraction by at least about 10%, such as at least about 15%, such as at least about 20%, such as at least about 30%.

In one embodiment, the soluble extracts fraction having a reduced level of tobacco-specific nitrosamines may be combined with the insoluble residue fraction having a reduced level of tobacco-specific nitrosamines. Further, the combination may yield a reconstituted tobacco product having a reduced level of tobacco-specific nitrosamines.

In general, any material capable of reducing the amount of nitrosamines in the soluble extracts fraction of the tobacco can be utilized in the present invention. For instance, in one embodiment, the nitrosamine-reducing material is selected from the group consisting of charcoal, activated charcoal, zeolite, sepiolite, activated sepiolite, and combinations thereof. Further, the nitrosamine-reducing material may also possess certain characteristics that enhance its ability to remove nitrosamines from the tobacco. In some embodiments, the nitrosamine-reducing material may include pores, channels, or combinations thereof, which have a mean diameter larger than about 3.5 angstroms, and in some embodiments, larger than about 7 angstroms.

In one embodiment, the nitrosamine-reducing material may comprise a sepiolite. The nitrosamine reducing material, such as the sepiolite, may have a specific surface area that is from about 50 to about 500 $m^2/g$, such as from about 100 to about 400 $m^2/g$, such as from about 200 to about 300 $m^2/g$, such as from about 225 to about 300 $m^2/g$, such as from about 240 to about 290 $m^2/g$, such as from about 260 to about 290 $m^2/g$, such as about 270 $m^2/g$. In one embodiment, the nitrosamine-reducing material may have a particle size such that less than about 15%, such as less than about 10%, such as less than about 5%, such as less than about 1% of the particles have a particle size larger than about 44 μm. In one embodiment, the sepiolite may have a particle size such that at least about 70%, such as at least about 80%, such as at least about 85%, such as at least about 90% of the particles have a particle size smaller than about 5 μm.

In general, any alkali extractant capable of reducing the amount of nitrosamines in the insoluble residue extracts fraction of the tobacco can be utilized in the present invention. For instance, in one embodiment, the alkali extractant is selected from the group consisting of potassium hydroxide, sodium hydroxide, a phosphate salt, a carbonate salt, and combinations thereof. In one embodiment, the alkali extractant may comprise only a hydroxide. In another embodiment, the alkali extractant may comprise only potassium hydroxide.

Further, the alkali extractant may be present in an amount that enhances its ability to remove nitrosamines from the tobacco. For example, in one embodiment, the alkali extractant may be prepared as an aqueous solution. The alkali extractant may be present in the solution from about 0.1 weight % to about 5 weight %, such as from about 0.1 weight % to about 2.5 weight %, such as from about 0.1 weight % to about 1 weight %, such as from about 0.2 weight % to about 0.7 weight %. In one embodiment, the alkali extraction solution may have a normality of at least about 0.05 N, such as at least about 0.1 N, such as at least about 0.15 N, such as at least about 0.25 N, such as at least about 0.5 N but less than about 2.0 N, such as less than about 1.5 N, such as less than about 1.0 N, such as less than about 0.5 N, such as less than about 0.25 N, such as less than about 0.1 N.

In one embodiment, the soluble extracts fraction may be treated with a nitrosamine-reducing material and the insoluble residue fraction may be optionally treated with an alkali extractant. In one embodiment, the soluble extracts fraction may be treated with a nitrosamine-reducing material comprising a sepiolite and the insoluble residue fraction may be optionally treated with an alkali extractant. The sepiolite may have a specific surface area of from about 200 to about 300 $m^2/g$, such as about 270 $m^2/g$, wherein less than 16% of the sepiolite particles have a particle size larger than about 44 μm. Both fractions may be recombined to yield a reconstituted tobacco product. The reconstituted tobacco product, when compared to a product without any treatment, may have a reduced tobacco-specific nitrosamines content per tobacco product by at least about 10%, such as at least about 20%, such as at least about 30%, such as at least about 40%, such as at least about 50%, such as at least about 55%. The tobacco-specific nitrosamines per milligram of nicotine may be reduced by at least about 5%, such as at least about 10%, such as at least about 20%, such as at least about 30%, such as at least about 40%, such as at least about 50%. For instance, the above reductions may be observed in the tobacco smoke of a reconstituted tobacco product in comparison to the smoke of a product without any treatment.

When the soluble extracts fraction is treated with a nitrosamine-reducing material comprising a sepiolite having a specific surface area of from about 200 to about 300 $m^2/g$, such as about 270 $m^2/g$, wherein less than 16% of the sepiolite particles have a particle size larger than about 44 μm and the insoluble residue fraction is optionally treated with an alkali extractant, the reconstituted tobacco product exhibits dramatically improved and unexpected results over the prior art.

In one embodiment, the soluble extracts fraction may be treated with a nitrosamine-reducing material and the insoluble residue fraction may be treated with an alkali extractant. Both fractions may be recombined to yield a reconstituted tobacco product. The reconstituted tobacco product, when compared to a product without any treatment, may have a reduced tobacco-specific nitrosamines content per tobacco product by at least about 20%, such as at least about 30%, such as at least about 40%, such as at least about 50%, such as at least about 55%. The tobacco-specific nitrosamines per milligram of nicotine may be reduced by at least about 20%, such as at least about 30%, such as at least about 40%, such as at least about 50%. For instance, the above reductions may be observed in the tobacco smoke of a reconstituted tobacco product in comparison to the smoke of a product without any treatment.

When the soluble extracts fraction is treated with a nitrosamine-reducing material and the insoluble residue fraction is treated with an alkali extractant, the reconstituted tobacco product exhibits dramatically improved and unexpected results over the prior art. In one particular embodiment, when the soluble extracts fraction is treated with a nitrosamine-reducing material comprising a sepiolite and the insoluble residue fraction is treated with an alkali extractant comprising a hydroxide, the reconstituted tobacco product exhibits further dramatically improved and unexpected results over the prior art. In another particular embodiment, when the soluble extracts fraction is treated with a nitrosamine-reducing material comprising a sepiolite having a specific surface area of from about 200 to about 300 $m^2/g$, such as about 270 $m^2/g$, wherein less than 16% of the sepiolite particles have a particle size larger than about 44 μm and the insoluble residue fraction is treated with an alkali extractant comprising a hydroxide, the reconstituted tobacco product exhibits even further dramatically improved and unexpected results over the prior art.

In one embodiment, the reconstituted tobacco product may be further treated with ascorbic acid, a mineral ascorbate, or a combination thereof. The ascorbic acid, mineral ascorbate, or a combination thereof may be applied to the reconstituted tobacco product as a solution. The reconstituted tobacco product may comprise from about 10 weight % to about 50 weight %, such as from about 15 weight % to about 35 weight %, such as from about 15 weight % to about 30 weight %, such as from about 18 weight % to about 25 weight % of the ascorbic acid, a mineral ascorbate, or a combination thereof.

In one embodiment, the soluble extracts fraction may be treated with a nitrosamine-reducing material and the insoluble residue fraction may be treated with an alkali extractant. Both fractions may be recombined to yield a reconstituted tobacco product. The reconstituted tobacco product may be further treated with ascorbic acid, a mineral ascorbate, or a combination thereof. The reconstituted tobacco product, when compared to a product without any treatment, may have a reduced tobacco-specific nitrosamines content per tobacco product by at least about 20%, such as at least about 30%, such as at least about 40%, such as at least about 45%. The tobacco-specific nitrosamines per milligram of nicotine may be reduced by at least about 20%, such as at least about 30%, such as at least about 35%, such as at least about 40%. For instance, the above reductions may be observed in the tobacco smoke of a reconstituted tobacco product in comparison to the smoke of a product without any treatment.

The nitrosamine-reducing material can generally be contacted with the soluble extracts fraction in any of a variety of different ways. For example, in one embodiment, the nitrosamine-reducing material can be mixed with the soluble extracts fraction. If desired, after contacting the soluble extracts fraction with the nitrosamine-reducing material, the nitrosamine-reducing material may optionally be removed therefrom.

The alkali extractant can generally be contacted with the insoluble residue fraction in any of a variety of different ways. For example, in one embodiment, the alkali extractant can be mixed with the insoluble residue fraction. If desired, after contacting the insoluble residue fraction with the alkali extractant, the alkali extractant may optionally be removed therefrom.

Other features and aspects of the present invention are described in more detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

DETAILED DESCRIPTION

Figure 1:
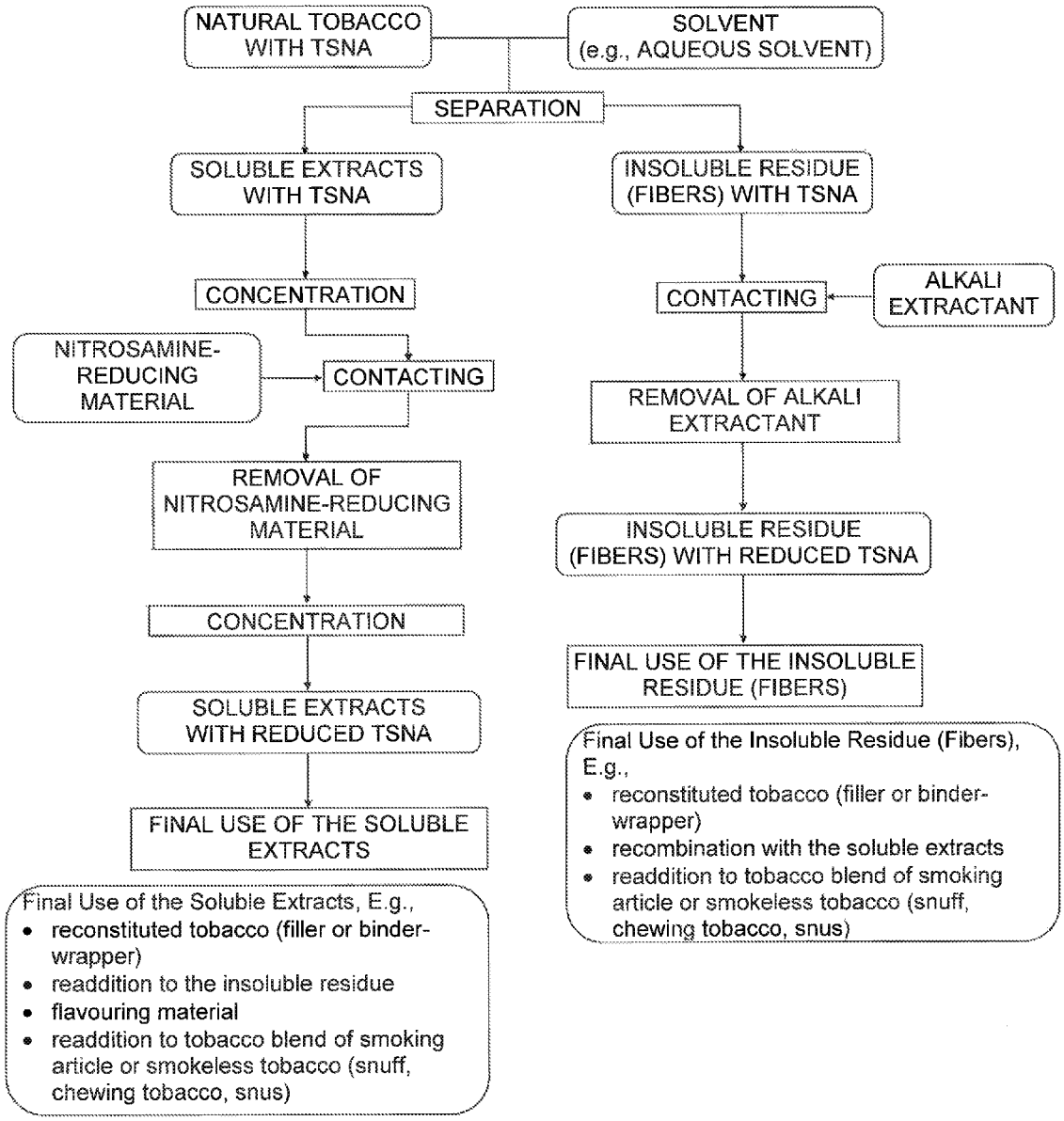
FIG. 1 is a schematic diagram of one embodiment of a method of the present invention for reducing the nitrosamine content of tobacco.

It is to be understood by one of ordinary skill in the art that the present discussion is a description of exemplary embodiments only and is not intended as limiting the broader aspects of the present disclosure.

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations and their equivalents.

As will be described in greater detail below, the method provides an efficient and effective reduction of tobacco-specific nitrosamines. In general, the present invention is directed to a method for reducing the presence of nitrosamines, such as tobacco-specific nitrosamines (TSNAs), in tobacco. As used herein, the term "tobacco" is meant to encompass natural tobacco (e.g. tobacco stems, such as flue-cured stems, fines, tobacco byproducts), reconstituted tobacco, tobacco extracts, blends thereof, and other tobacco-containing materials.

In particular, in one embodiment, the method includes combining tobacco having an initial level of tobacco-specific nitrosamines with an aqueous solvent (e.g., water and/or other compounds) to form a soluble extracts fraction and an insoluble residue fraction. The soluble extracts fraction and insoluble residue fraction may also contain an initial total level of tobacco-specific nitrosamines. Thereafter, the presence of nitrosamines may be reduced in the soluble extracts fraction and the insoluble residue fraction. The tobacco-specific nitrosamines may be reduced in the soluble extracts fraction using a nitrosamine-reducing material (e.g., adsorbent or absorbent) to provide a soluble extracts fraction having a reduced level of tobacco-specific nitrosamines. The tobacco-specific nitrosamines may be reduced in the insoluble residue fraction using an alkali extractant to provide an insoluble residue fraction having a reduced level of tobacco-specific nitrosamines. Subsequently, the soluble extracts fraction having a reduced level of tobacco-specific nitrosamines and insoluble residue fraction having a reduced level of tobacco-specific nitrosamines may be recombined to yield a reconstituted tobacco product.

The present inventors have discovered that this method can dramatically reduce tobacco-specific nitrosamines in the smoke and tobacco product when compared to other methods. In order to provide an efficient and effective method in accordance with the present disclosure, various combinations of treatments can be performed on the tobacco material in order to achieve the desired objectives. In particular, according to the present disclosure, a synergistic effect may be realized by reducing the tobacco-specific nitrosamines in both a soluble extracts fraction and an insoluble residue fraction.

In particular, the present inventors have discovered an effective method for the reduction of tobacco-specific nitrosamines by treating an insoluble residue fraction with an alkali extractant and a soluble extracts fraction with a nitrosamine-reducing material. Because of the processing difficulties, efficiency concerns, and expenses in treating both the soluble extracts fraction and the insoluble residue fraction, prior attempts have not been made to produce a reconstituted tobacco product using such method. However, the present inventors have discovered that the above steps can lead to a reconstituted tobacco product that produces significantly less tobacco-specific nitrosamines. In particular, the present inventors have discovered that the above steps can provide a reconstituted tobacco product that produces significantly less tobacco-specific nitrosamines in the smoke, saliva extracts, and/or aerosol. Even further, the present inventors have discovered that the above steps can be conducted to provide a reconstituted tobacco product that produces significantly less tobacco-specific nitrosamines and also minimally affecting other Hoffmann analytes.

Nitrosamine-Reducing Material

In some embodiments, the nitrosamine-reducing material can be selected from the group consisting of charcoal, activated charcoal, zeolite, activated sepiolite, and the like, and can be utilized to reduce the nitrosamine content of tobacco.

The nitrosamine-reducing material generally has an affinity for nitrosamines such that the resulting content of the nitrosamine in tobacco can be reduced. For instance, without intending to be limited by theory, it is believed that, in some embodiments, the nitrosamine-reducing material "adsorbs" nitrosamines. As used herein, the term "adsorb" generally refers to the retention of solid, liquid or gas molecules or atoms on the surface of a solid or liquid. Moreover, in some instances, the nitrosamine-reducing material may also "absorb" nitrosamines. As used herein, the term "absorb" generally refers to the extraction of solid, liquid, or gas molecules or atoms into the bulk of a material when contacted therewith.

The nitrosamine-reducing material may also possess other characteristics that enable it to enhance the ability of the material to reduce the content of nitrosamines in tobacco. For example, the nitrosamine-reducing material can possess a certain surface area, mean pore/channel size, etc. In some embodiments, for instance, the nitrosamine-reducing material can have a surface area of greater than about 600 square meters per gram, and in some embodiments, greater than about 1000 square meters per gram. Further, the nitrosamine-reducing material may also include pores/channels that have a mean diameter larger than about 3.5 angstroms, such as larger than about 7 angstroms, such as between about 7 to about 10 angstroms.

Any material capable of reducing nitrosamine content may generally be utilized in the present invention. For example, activated charcoal can be utilized as the nitrosamine-reducing material. Some suitable types of activated charcoal include, but are not limited to, wood activated charcoal, coconut activated charcoal, activated charcoal cloth (e.g., Activated Charcoal Cloth obtained from Chemviron Carbon, Ltd., England), and the like. In addition, other nitrosamine-reducing materials may also be utilized. For example, in some embodiments, a zeolite can be utilized. In one embodiment, for instance, a hydrophobic zeolite can be utilized that has the following general formula:

$$M_m M'_n M''_p [aAlO_2 . bSiO_2 . cTO_2] Q_r$$

wherein,

M is a monovalent cation,

M' is a divalent cation,

M" is a trivalent cation, c, m, n, p, and r are greater than or equal to 0, a, b are greater than or equal to 1, T is a tetrahedrally coordinated metal atom, and Q is a sorbate molecule corresponding to the pore geometry of the zeolite.

Moreover, sepiolites may also be utilized as the nitrosamine-reducing material. A sepiolite is a hydrated magnesium silicate that belongs to the phyllosilicate group. In one embodiment, for example, a sepiolite having zeolitic channels between about 3.6 angstroms to about 10.6 angstroms may be particularly well suited in the present invention, and may have the following formula:

$$Si_{12}Mg_8O_{30}(OH)_4 . 12H_2O$$

In one embodiment, the nitrosamine reducing material, such as the sepiolite, may have a specific surface area that is from about 50 to about 500 $m^2/g$, such as from about 100 to about 400 $m^2/g$, such as from about 200 to about 300 $m^2/g$, such as from about 225 to about 300 $m^2/g$, such as from about 240 to about 290 $m^2/g$, such as from about 260 to about 290 $m^2/g$. In one embodiment, the sepiolite may have a specific surface area of about 270 $m^2/g$. In one embodiment, the nitrosamine-reducing material may have a particle size such that less than about 1%, such as less than about 5%, such as less than about 10%, such as less than about 15% of the particles have a particle size of larger than about 44 μm. In one embodiment, the sepiolite may have a particle size such that at least about 70%, such as at least about 80%, such as at least about 85%, such as at least about 90% of the particles have a particle size smaller than about 5 μm. In one embodiment, the sepiolite may comprise less than about 30%, such as less than about 20%, such as less than about 10% of other clays. Suitable commercially available sepiolites include, but are not limited to, Pansil®, Pansil® 100, Pansil® 400, and Pangel® FF (TOLSA Group, Spain).

Regardless of the particular nitrosamine-reducing material selected, it can generally be utilized in a variety of different ways to reduce the nitrosamine content of tobacco. In particular, the present inventors have discovered that enhanced removal of nitrosamines can be accomplished by contacting a nitrosamine-reducing material with a soluble extracts fraction of tobacco.

Alkali Extractant

The present inventors have found that by combining a soluble extracts treatment with an insoluble residue treatment, a more efficient method of reducing the tobacco-specific nitrosamines can be obtained.

The alkali extractant may be used to extract nitrogen-containing compounds such as tobacco-specific nitrosamines from tobacco such that the resulting content of the nitrosamines in tobacco can be reduced. In some embodiments, the alkali extractant utilized to reduce the nitrosamine content of tobacco can be selected from the group consisting of potassium hydroxide, sodium hydroxide, a phosphate salt, a carbonate salt, or a combination thereof. In one embodiment, the alkali extractant may comprise only a hydroxide. In one embodiment, the alkali extractant may comprise only potassium hydroxide. In one embodiment, the alkali extractant may not comprise hydrogen peroxide. In one embodiment, the alkali extractant may not comprise an acetate such as sodium acetate.

The alkali extractant may be present in an amount that enhances its ability to remove nitrosamines from the tobacco. For example, in one embodiment, the alkali extractant may be prepared as an aqueous solution. The alkali extractant may be present in the solution from about 0.1 weight % to about 5 weight %, such as from about 0.1 weight % to about 2.5 weight %, such as from about 0.1 weight % to about 1 weight %, such as from about 0.2 weight % to about 0.7 weight %. In one embodiment, the alkali extraction solution may have a normality of at least about 0.05 N, such as at least about 0.1 N, such as at least about 0.15 N, such as at least about 0.25 N, such as at least about 0.5 N but less than about 2.0 N, such as less than about 1.5 N, such as less than about 1.0 N, such as less than about 0.5 N, such as less than about 0.25 N, such as less than about 0.1 N.

Regardless of the particular alkali extractant selected, it can generally be utilized in a variety of different ways to reduce the nitrosamine content of tobacco. In particular, the present inventors have discovered that enhanced removal of nitrosamines can be accomplished by contacting an alkali extractant with an insoluble residue fraction of tobacco.

Process for Reducing Tobacco-Specific Nitrosamines

For example, referring to FIG. 1, one embodiment of a method for removing nitrosamines from tobacco will now be described in more detail. As shown, a tobacco furnish containing tobacco stems (e.g., flue-cured stems), fines and/or other tobacco by-products from tobacco manufacturing processes is initially mixed with a solvent (e.g., water and/or other compounds) at elevated temperatures. For example, various solvents that are water-miscible, such as alcohols (e.g., ethanol), can be combined with water to form an aqueous solvent. The water content of the aqueous solvent can, in some instances, be greater than 50% by weight of the solvent, and particularly greater than 90% by weight of the solvent. Deionized water, distilled water or tap water may be employed. The amount of the solvent in the suspension can vary widely, but is generally added in an amount from about 75% to about 99% by weight of the suspension. However, the amount of solvent can vary with the nature of the solvent, the temperature at which the extraction is to be carried out, and the type of tobacco furnish.

After forming the solvent/tobacco furnish mixture, some or all of a soluble extracts fraction of the furnish mixture may be optionally separated (e.g., extracted) from the mixture. If desired, the aqueous solvent/tobacco furnish mixture can be agitated during extraction by stirring, shaking or otherwise mixing the mixture in order to increase the rate of extraction. Typically, extraction is carried out for about 0.5 hours to about 6 hours. Moreover, although not required, typical extraction temperatures range from about 10° C. to about 100° C.

Once separated from the insoluble residue fraction of the tobacco solution, the soluble extracts fraction can optionally be concentrated using any known type of concentrator, such as a vacuum evaporator. In one embodiment, the soluble component may be highly concentrated.

The soluble extracts fraction may be contacted with a nitrosamine-reducing material for removing nitrosamines therefrom. For example, in one embodiment of the present invention, as shown in FIG. 1, the nitrosamine-reducing material is directly mixed with the soluble extracts fraction (e.g., aqueous extract). As a result, nitrosamines within the soluble extracts fraction can be removed and readily retained by the nitrosamine-reducing material. In general, any effective amount of nitrosamine-reducing material can be utilized. For instance, in one embodiment, the soluble extracts fraction can be combined with a nitrosamine-reducing material such that it is present in an amount greater than about 0.5% by weight of the solution, in some embodiments, between about 0.5% to about 50% by weight of the solution, and in some embodiments, between about 5% to about 50% by weight of the solution.

Other techniques for contacting the soluble extracts fraction with the nitrosamine-reducing material can also be utilized. For example, in one embodiment, the soluble extracts fraction can be filtered through a charcoal filter. Moreover, in another embodiment, the soluble extracts fraction can be conveyed over a charcoal bed, cartridge, or cloth. For example, in another embodiment, the soluble extracts fraction can be contacted with a sepiolite. It should be understood, however, that any other suitable technique for contacting the nitrosamine-reducing material with the soluble extracts fraction may also be utilized in accordance with the present invention.

Referring again to FIG. 1, after being mixed with the soluble extracts fraction, the nitrosamine-reducing material may then be optionally removed therefrom. For example, the nitrosamine-reducing material can be removed from the soluble extracts fraction utilizing well-known techniques, such as centrifugation, decantation, filtration, etc. Thereafter, the nitrosamine-reducing material can be transferred to a waste disposal station (not shown) or recycled for the further removal of nitrosamines.

After contacting the soluble extracts fraction with the nitrosamine-reducing material, using techniques such as described above, the soluble extracts fraction can optionally be concentrated. Moreover, the concentrated or unconcentrated soluble extracts fraction can be utilized in any manner desired. For example, in one embodiment, nitrosamine-reduced soluble extracts fraction can be used as a flavoring material for tobacco products. In another embodiment, the soluble extracts fraction can be dried and/or applied to a porous material used in a heat-not-burn tobacco product.

Once extracted, the insoluble residue fraction can optionally be subjected to one or more mechanical refiners to produce a fibrous pulp. Some examples of suitable refiners can include disc refiners, conical refiners, and the like.

Additionally, the present inventors have discovered that a synergistic effect may be realized by also treating the insoluble residue fraction to provide an efficient and effective method for reducing tobacco-specific nitrosamines. Therefore, the insoluble residue fraction may be contacted with an alkali extractant for removing nitrosamines therefrom. For example, in one embodiment of the present invention, as shown in FIG. 1, an alkali extractant is directly mixed with the insoluble residue fraction (e.g., fibers). As a result, nitrosamines within the insoluble residue fraction can be extracted using the alkali extractant. In general, any effective amount of alkali extractant can be utilized. For instance, in one embodiment, the ratio of the alkali extractant solution (mL) to the insoluble residue fraction (g) can be at least about 0.1, such as at least about 0.5, such as at least about 1, such as at least about 3, such as at least about 5, such as at least about 10, such as at least about 15, such as at least about 20 and less than about 40, such as less than about 30, such as less than about 20, such as less than about 10, such as less than about 5. However, the amount of alkali extractant can vary with the nature of the extractant, the temperature at which the extraction is to be carried out, and the type of tobacco furnish. Some examples of processes for contacting an insoluble residue fraction with an alkali extractant are described in U.S. Pat. Nos. 4,716,911; 6,508,254; 6,772,767; which are also incorporated herein in their entirety by reference thereto for all purposes.

The alkali extractant solution may have a pH of from about 3.5 to about 14, such as from about 5 to about 14, such as from about 7 to about 14. The insoluble fraction can be contacted with the alkali extractant at a temperature of at least about 10° C., such as at least about 50° C., such as from about 50° C. to about 150° C., such as from about 70° C. to about 100° C. The extraction may occur for a duration of about 0.25 hours to 24 hours, such as from about 0.5 hours to about 8 hours, such as from about 0.5 hours to about 5 hours, such as about 1 hour. The amount extracted can depend on factors such as the surface area of the tobacco, the extraction temperature, the solution concentration, and the extraction time.

Other techniques for contacting the insoluble residue fraction with the alkali extractant can also be utilized, For example, in one embodiment, the alkali extractant can be passed through the insoluble residue fraction. Moreover, in another embodiment, the alkali extractant can be conveyed over the insoluble residue fraction. In another embodiment, the alkali extractant can be mixed within the insoluble residue fraction. It should be understood, however, that any other suitable technique for contacting the alkali extractant with the insoluble residue fraction may also be utilized in accordance with the present invention.

Referring again to FIG. 1, after being mixed with the insoluble residue fraction, the alkali extractant may then be optionally removed therefrom. For example, the alkali extractant can be removed from the insoluble residue fraction utilizing well-known techniques, such as centrifugation, decantation, filtration, etc. Thereafter, the alkali extractant can be transferred to a waste disposal station (not shown) or recycled for the further removal of nitrosamines.

After contacting the insoluble residue fraction with the alkali extractant, using techniques such as described above, in one embodiment, the insoluble residue fraction may be washed with an aqueous solvent to remove excess alkali extractant. For instance, the solvent may comprise water. The solvent may also comprise a dilute acid such as a dilute acetic acid or dilute hydrochloric acid. The solvent may comprise water, a dilute acid, or a combination thereof. The acetic acid or dilute acid may be present in the solution from about 0.1 weight % to about 2 weight %, such as from about 0.25 weight % to about 1.5 weight %, such as from about 0.3 weight % to about 0.7 weight %, such as at about 0.5 weight %. The insoluble residue fraction may be washed at any effective temperature such as from about 10° C. to about 100° C., such as from about 50° C. to about 100° C., such as at about 80° C.

After contacting the insoluble residue fraction with the alkali extractant, using techniques such as described above, the insoluble residue fraction can be utilized in any manner desired. For example, in one embodiment, nitrosamine-reduced insoluble residue fraction can be used as to produce reconstituted tobacco or a tobacco article.

In other embodiments, the soluble extracts fraction can be recombined with the insoluble residue fraction to form reconstituted tobacco (filler or binder-wrapper). Specifically, the nitrosamine-reduced soluble extracts fraction can be reapplied to the sheet, tobacco blend, insoluble residue, etc., using various application methods, such as spraying, using sizing rollers, saturating, and the like. In one embodiment, the insoluble residue fraction may be in the form of a pulp that is then transferred to a papermaking station (not shown) that includes a forming apparatus, which may include, for example, a forming wire, gravity drain, suction drain, felt press, Yankee dryer, drum dryers, etc. In such a forming apparatus, the pulp is laid onto a wire belt forming a sheet-like shape and excess water is removed by the gravity drain and suction drain and presses. Thereafter, the soluble extracts fraction may be reapplied to the insoluble residue fraction. When the insoluble residue fraction is recombined with the soluble extracts fraction, the resulting tobacco product is generally known as "reconstituted tobacco."

Reconstituted tobacco can generally be formed in a variety of ways. For instance, in one embodiment, band casting can be utilized to form the reconstituted tobacco. Band casting typically employs a slurry of finely divided tobacco parts and a binder that is coated onto a steel band and then dried. After drying, the sheet is blended with natural tobacco strips or shredded and used in various tobacco products, including as a cigarette filler. Some examples of process for producing reconstituted tobacco are described in U.S. Pat. Nos. 3,353,541; 3,420,241; 3,386,449; 3,760,815; and 4,674,519; which are incorporated herein in their entirety by reference thereto. Reconstituted tobacco can also be formed by a papermaking process. Some examples of processes for forming reconstituted tobacco according to this process are described in U.S. Pat. Nos. 3,428,053; 3,415,253; 3,561,451; 3,467,109; 3,483,874; 3,860,012; 3,847,164; 4,182,349; 5,715,844; 5,724,998; and 5,765,570; which are also incorporated herein in their entirety by reference thereto for all purposes. For example, the formation of reconstituted tobacco using papermaking techniques can involve the steps of mixing tobacco with water, extracting the soluble ingredients therefrom, concentrating the soluble ingredients, refining the tobacco, forming a web, reapplying the concentrated soluble ingredients, drying, and threshing.

In one embodiment, the tobacco soluble extracts fraction is recombined with the tobacco material such that the resulting reconstituted tobacco contains greater than about 10%, such as greater than about 15%, such as greater than about 20%, such greater than about 30%, such as greater than about 35%, such as such as greater than about 40%, such as greater than about 45% of tobacco solubles. The reconstituted tobacco generally contains less than about 50%, such as less than about 45% of tobacco solubles.

In one embodiment of the present invention, the reconstituted tobacco product may be treated with ascorbic acid, a mineral ascorbate, or a combination thereof. Ascorbic acid, commonly referred to as Vitamin C, is known to provide antioxidant properties and may prevent and/or undo damage to cells and genetic material from environmental toxins and certain sources of radiation. The mineral ascorbates may be comprised of sodium ascorbate, calcium ascorbate, potassium ascorbate, magnesium ascorbate, zinc ascorbate, and combinations thereof.

The ascorbic acid, mineral ascorbate, or a combination thereof may be present as a solution. The concentration of the ascorbic acid solution, mineral ascorbate solution, or a combination thereof may be from about 100 g/L to about 400 g/L, such as from about 150 g/L to about 300 g/L, such as from about 200 g/L to about 275 g/L, such as about 250 g/L.

The solution may be applied by any method generally known in the art. In one embodiment, the tobacco product may be treated with ascorbic acid, a mineral ascorbate, or a combination thereof by a spraying application. Regardless of the method of application, the resulting reconstituted tobacco product may comprise from about 10 weight % to about 50 weight %, such as from about 15 weight % to about 35 weight %, such as from about 15 weight % to about 30 weight %, such as from about 18 weight % to about 25 weight % of the ascorbic acid, a mineral ascorbate, or a combination thereof.

In addition, various other ingredients, such as flavor or color treatments, can also be applied to the web. If applied with the soluble extracts fraction and/or other ingredients, the fibrous sheet material can, in some embodiments, then be dried using, for example, a tunnel dryer, to provide a sheet having a typical moisture content of less than 20% by weight, and particularly from about 9% to about 14% by weight. Subsequently, the sheet can be cut to a desired size and/or shape and dried to the desired final moisture content.

Figure 2:
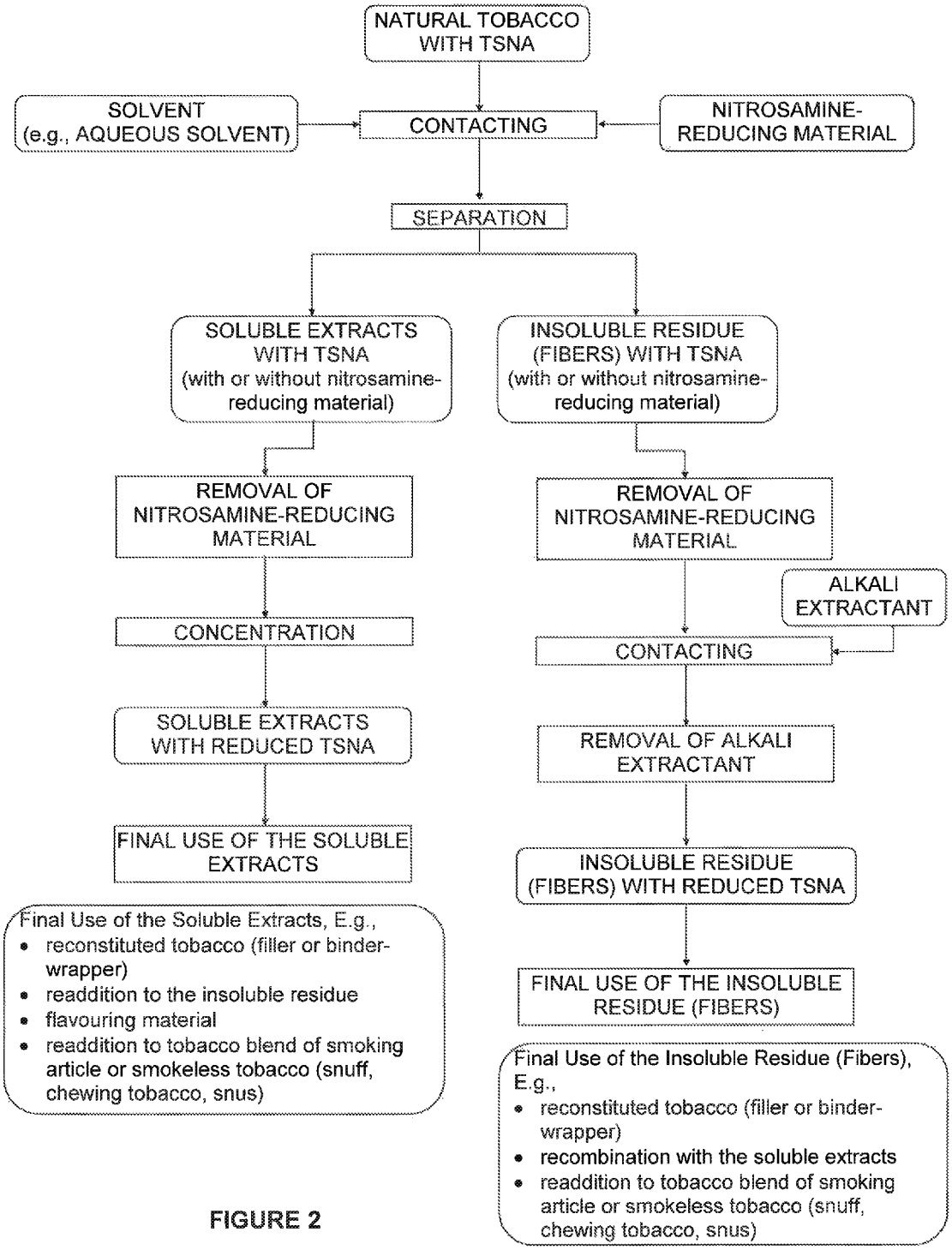
FIG. 2 is a schematic diagram of another embodiment of a method of the present invention for reducing the nitrosamine content of tobacco.

Referring to FIG. 2, another embodiment for removing nitrosamines from tobacco will now be described in more detail. Initially, a tobacco furnish containing tobacco stems (e.g., flue-cured stems), fines and/or other tobacco by-products from tobacco manufacturing processes can be placed into contact with a solvent, as described above, and a nitrosamine-reducing material for removing nitrosamines therefrom. In general, a variety of techniques can be utilized to remove the nitrosamines. For example, in one embodiment of the present invention, as shown in FIG. 2, a nitrosamine-reducing material can be directly mixed with the tobacco and solvent. As a result, nitrosamines within the soluble extracts fraction can be removed and readily retained by the nitrosamine-reducing material. Other suitable contacting techniques can also be used, including, but not limited to, contacting tobacco mixture with a cartridge or bed containing a nitrosamine-reducing material. The mixture is then separated and the nitrosamine-reducing material optionally removed, such as described above.

The insoluble residue fraction can be placed into contact with an alkali extractant, as described above, for removing nitrosamines therefrom. Thereafter, the alkali extractant can optionally be removed, such as described above. The soluble extracts fraction and insoluble residue fraction can also be utilized in a manner as described above. Moreover, the soluble extracts fraction can be optionally concentrated using various well-known techniques.

Figure 3:
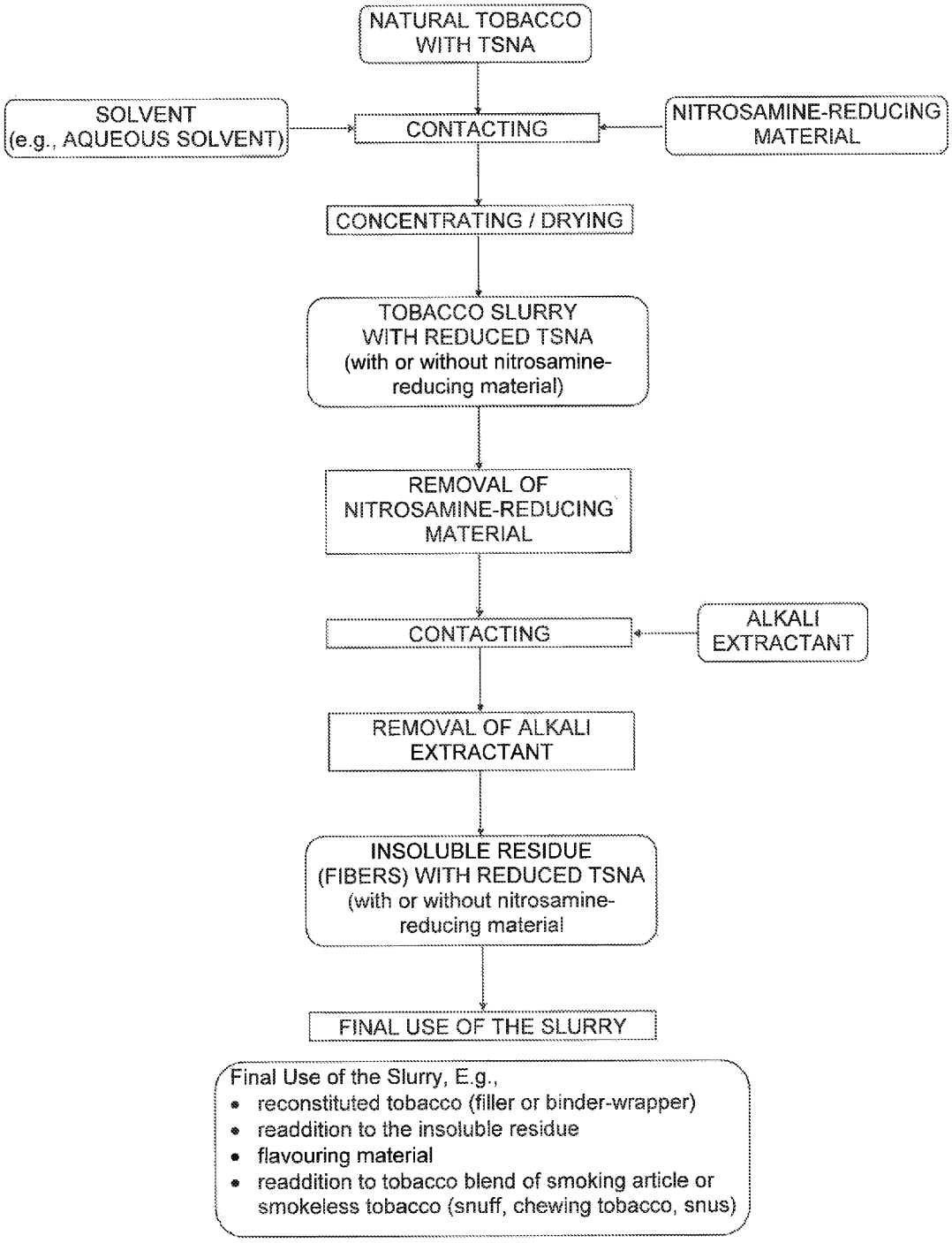
FIG. 3 is a schematic diagram of another embodiment of a method of the present invention for reducing the nitrosamine content of tobacco.

Referring to FIG. 3, after the tobacco is placed into contact with a nitrosamine-reducing material, such as shown in FIG. 2, the resulting mixture can, in some embodiments, then be optionally concentrated and/or dried. The nitrosamine-reducing material can optionally be removed from the tobacco slurry mixture as described above. The resulting tobacco slurry mixture can possess a reduced nitrosamine content. The tobacco slurry mixture can be contacted with an alkali extractant which can optionally be removed therefrom as described above. The resulting tobacco slurry mixture can possess an even further reduced nitrosamine content. The tobacco slurry mixture can be used in a wide variety of applications, such as, for example, in snuff tobacco, in snus tobacco, in chewing tobacco, during reconstitution, etc.

Although various embodiments for contacting a nitrosamine-reducing material and an alkali extractant with tobacco have been described above, it should be understood that the nitrosamine-reducing material and alkali extractant can generally be contacted with tobacco in any manner desired. For example, in some embodiments, the nitrosamine-reducing material can be added to a wet sheet as it is formed. In some embodiments, the alkali extractant can also be added to a wet sheet as it is formed, It should also be understood that, if desired, more than one nitrosamine-reducing material and/or alkali extractant can be utilized and that such material(s) can be applied at more than one stage of a process.

As a result of the present invention, it has been discovered that the nitrosamine content of tobacco can be selectively reduced. For instance, it has been discovered that the total content of nitrosamines, such as N'-Nitrosonomicotine (NNN), 4-(Methylnitrosamino)-1-(3-pyridyl)-1-butanone (NNK), N'-Nitrosoanatabine (NAT), and N'-Nitrosoanabasine (NAB) can be reduced when treating a soluble extracts fraction with a nitrosamine-reducing material and/or an insoluble residue fraction with an alkali extractant. Even further, the present inventors have discovered that the above steps can be conducted to provide a reconstituted tobacco product that produces significantly less tobacco-specific nitrosamines and also minimally affecting other Hoffmann analytes. In one embodiment, using the method according to the present invention, some Hoffman analytes may even be further reduced. For instance, the method of the present invention may also reduce the amount of hydrogen cyanide, quinoline, hydroquinone, cresols, and aromatic amines.

In one embodiment, the soluble extracts fraction may be treated while the insoluble residue fraction is optionally treated. Both fractions may be recombined to yield a reconstituted tobacco product. The reconstituted tobacco product, when compared to a product without any treatment, may have a reduced tobacco-specific nitrosamines content per tobacco product by at least about 10%, such as at least about 15%, such as at least about 20%. The tobacco-specific nitrosamines per milligram of nicotine may be reduced by at least about 5%, such as at least about 8%, such as at least about 10%. For instance, the above reductions may be observed in the tobacco smoke of a reconstituted tobacco product in comparison to the smoke of a product without any treatment.

When the soluble extracts fraction is treated with a nitrosamine-reducing material comprising a sepiolite having a specific surface area of from about 200 to about 300 $m^2/g$, such as about 270 $m^2/g$, wherein less than 16% of the sepiolite particles have a particle size larger than about 44 μm and the insoluble residue fraction is optionally treated with an alkali extractant, the reconstituted tobacco product exhibits dramatically improved and unexpected results over the prior art.

In one embodiment, the insoluble residue fraction may be treated while the soluble extracts fraction is optionally treated. Both fractions may be recombined to yield a reconstituted tobacco product. The reconstituted tobacco product, when compared to a product without any treatment, may have a reduced tobacco-specific nitrosamines content per tobacco product by at least about 10%, such as at least about 20%, such as at least about 30%, such as at least about 35%. The tobacco-specific nitrosamines per milligram of nicotine may be reduced by at least about 10%, such as at least about 20%, such as at least about 25%, such as at least about 30%. For instance, the above reductions may be observed in the tobacco smoke of a reconstituted tobacco product in comparison to the smoke of a product without any treatment.

In one embodiment, the soluble extracts fraction and the insoluble residue fraction may be treated. Both fractions may be recombined to yield a reconstituted tobacco product. The reconstituted tobacco product, when compared to a product without any treatment, may have a reduced tobacco-specific nitrosamines content per tobacco product by at least about 20%, such as at least about 30%, such as at least about 40%, such as at least about 50%, such as at least about 55%. The tobacco-specific nitrosamines per milligram of nicotine may be reduced by at least about 20%, such as at least about 30%, such as at least about 40%, such as at least about 50%. For instance, the above reductions may be observed in the tobacco smoke of a reconstituted tobacco product in comparison to the smoke of a product without any treatment.

When the soluble extracts fraction is treated with a nitrosamine-reducing material and the insoluble residue fraction is treated with an alkali extractant, the reconstituted tobacco product exhibits dramatically improved and unexpected results over the prior art. In one particular embodiment, when the soluble extracts fraction is treated with a nitrosamine-reducing material comprising a sepiolite and the insoluble residue fraction is treated with an alkali extractant comprising a hydroxide, the reconstituted tobacco product exhibits further dramatically improved and unexpected results over the prior art. In another particular embodiment, when the soluble extracts fraction is treated with a nitrosamine-reducing material comprising a sepiolite having a specific surface area of from about 200 to about 300 $m^2/g$, such as about 270 $m^2/g$, wherein less than 16% of the sepiolite particles have a particle size larger than about 44 μm and the insoluble residue fraction is treated with an alkali extractant comprising a hydroxide, the reconstituted tobacco product exhibits even further dramatically improved and unexpected results over the prior art.

In one embodiment, the soluble extracts fraction and the insoluble residue fraction may be treated. Both fractions may be recombined to yield a reconstituted tobacco product. The reconstituted tobacco product may then be further treated with ascorbic acid, a mineral ascorbate, or a combination thereof. The reconstituted tobacco product, when compared to a product without any treatment, may have a reduced tobacco-specific nitrosamines content per tobacco product by at least about 20%, such as at least about 30%, such as at least about 40%, such as at least about 45%. The tobacco-specific nitrosamines per milligram of nicotine may be reduced by at least about 20%, such as at least about 30%, such as at least about 35%, such as at least about 40%. For instance, the above reductions may be observed in the tobacco smoke of a reconstituted tobacco product in comparison to the smoke of a product without any treatment.

In addition, significantly improved tobacco products may be formed therefrom from tobacco in accordance with the present invention. As used herein, the term "tobacco product" is meant to encompass smoking articles (e.g., cigarettes, cigars, fine cut smoking articles, pipes, etc.), smokeless articles (e.g., chewing tobacco, snuff, snus, etc.), heat-not-burn tobacco products (e.g., products which produce smoke or a smoke-like aerosol wherein an internal or an external heat source generally vaporizes the nicotine instead of utilizing combustion or a nicotine-extract liquid), tobacco additives (e.g., for use as flavorants, etc.), and the like. For example, when the soluble extracts fraction having a reduced level of nitrosamines is incorporated into a smoking article, smoke produced by the smoking article can also contain a lower content of nitrosamines.

For instance, the product may have a reduced nicotine content of at least about 1%, such as at least about 2%, such as at least about 5%, such as at least about 10%. The product may have a puff count of from about 4 to about 10 such as from about 5 to about 6. When treating the product with ascorbic acid, a mineral ascorbate, or a combination thereof, the product may have a puff count of from about 8 to about 9.

In one embodiment, the tobacco product may also comprise a reconstituted tobacco sheet. The reconstituted tobacco sheet may have a reduced content of tobacco specific nitrosamines. The reconstituted tobacco sheet may be further processed to produce a reconstituted tobacco strip. For instance, the sheets can be cut into fine strips. The strips may be immediately used without any further processing. In one embodiment, the reconstituted tobacco sheets may be further treated with an additive such as a humectant, a natural and/or artificial flavorant, a wet strength agent, or any combination thereof.

As indicated, a wet strength agent may be added in order to reduce potential degradation of the reconstituted material when it is brought into contact with a liquid (e.g. water), such as when exposed to water such as saliva in the mouth when using oral tobaccos. Any suitable wet strength agent preferably selected for food and/or contact food applications may be used such as alkyl succinic anhydride; polyvinylamines; oxidized polysaccharides (such as oxidatively degraded starch); polyimines such as polyethyleneimine. Wet strength agents are well known to the skilled person and described in Ingredients Standards, such as BFR (Bundesinstitut für Risikobewertung) XXXVI and BFR XXXVI/1 or FDA (Food & Drug Administration) 21 CFR 176.170, FDA 21 CFR 176.110, FDA 21 CFR 176.120, FDA 21 CFR 176.1180. The wet strength agent is for example used in an amount of about 0.1% w/w to about 20% w/w, preferably from about 1% w/w to about 10% w/w, more preferably from about 2% w/w to about 7% w/w, such as about 5% w/w. The wet strength agent is preferably added to the fibrous portion when or before making the reconstituted sheet.

In addition to the above, the use of reconstituted tobacco strips provides a smokeless tobacco article and another method of delivering nicotine with a highly reduced content of tobacco specific nitrosamines.

For instance, in one embodiment, the strip may have a substantially square shape or a substantially rectangular shape. However, it should be understood that the strips may take any general shape. For instance, the shape may be of any general shape allowing a user to place the strip directly into their mouth for consumption, and in particular directly between the gum and the lip. In one embodiment, the sheets may be cut into strips having an area of from about 0.5 $cm^2$ to about 20 $cm^2$, such as from about 0.5 $cm^2$ to about 10 $cm^2$, such as from about 1 $cm^2$ to about 5 $cm^2$.

Additionally, the weight of the tobacco strip may vary depending on the product density, surface characteristics and treatment, and thickness. In one embodiment, the tobacco strip may weigh from about 0.2 grams to about 2 grams, such as from about 0.5 grams to about 1 gram.

The content of tobacco specific nitrosamines can be measured utilizing any method known in the art. For instance, the content can be analyzed by standard methods using gas chromatography mass spectrometry, liquid chromatography mass spectrometry, or a combination thereof. Additionally, particle size and specific surface area can be measured using any method known in the art. As is well known in the art, particle size can be measured using laser diffraction or dynamic light scattering. As is well known in the art, specific surface area can be measured using adsorption methods such as a BET adsorption method using nitrogen gas.

The process as described above provides advantages over conventionally formed reconstituted tobacco products. The present inventors have discovered that this method can dramatically reduce tobacco-specific nitrosamines in the smoke and tobacco product when compared to other methods. In particular, the present inventors have discovered a synergistic effect when reducing the tobacco-specific nitrosamines in both a soluble extracts fraction and an insoluble residue fraction. In particular, the present inventors have discovered an effective method for the reduction of tobacco-specific nitrosamines by treating an insoluble residue fraction with an alkali extractant and a soluble extracts fraction with a nitrosamine-reducing material. The present inventors have discovered that the above steps can lead to a reconstituted tobacco product that produces significantly less tobacco-specific nitrosamines.

The present disclosure may be better understood with reference to the following examples.

EXAMPLES

The examples of the invention are given below by way of illustration and not by way of limitation.

The following experiments were conducted in order to show some of the benefits and advantages of the present invention.

Example 1

Sepiolites that may be used in accordance with the present invention include, but are not limited to, Pangel® FF, Pansil®, Pansil® 400, and Pansil® 100. These sepiolites are hydrated magnesium silicates with the formula $Si_{12}Mg_8O_{30}(OH)_4.12H_2O$. However, any sepiolite having the characteristics disclosed in the present application may be utilized to reduce TSNAs, The chemical and physical properties of these sepiolites are given below in Table 1.

TABLE 1

Properties of Sepiolites

| Sepiolite | Sepiolite (%) | Other Clays (%) | Particle Size | Specific Surface Area ($m^2/g$) |
|---|---|---|---|---|
| Pansil ® | >85% | <15% | Finer than 5 μm: >80% | 288 |
| Pangel ® FF | >70% | <30% | Residue on 44 μm: <16% | 270 |
| Pansil ® 400 | 60% | 40% | Finer than 38 μm: >80% | 230 |
| Pansil ® 100 | 60% | 40% | Residue on 125 μm: <35% Finer than 38 μm: <35% | 240 |

For Pansil®, at least more than about 80% of the particles have a particle size smaller than about 5 μm. For Pangel® FF, at least less than about 16% of the particles have a particle size larger than about 44 μm. For Pansil® 400, at least more than about 80% of the particles have a particle size smaller than about 38 μm. For Pansil® 100, at least less than about 35% of the particles have a particle size larger than about 125 μm.

Example 2

The ability of sepiolite Pangel® FF to reduce the presence of tobacco-specific nitrosamines in a soluble extracts fraction was demonstrated.

Sepiolite Pangel® FF (83 g; 30% w/w dry matter) was contacted with three liters of tobacco soluble extracts at 60° C. for one hour using a vortex at 350 RPM to provide mechanical agitation. After removing the sepiolite, the treated soluble extracts fraction was analyzed. The treated soluble extracts fraction and control soluble extracts fraction were tested for the content of NNN, NNK, NAT, NAB, nitrates, nitrites, alkaloids, and reducing substances.

The results for the control soluble extracts fraction and the treated soluble extracts fraction are given below in Table 2.

TABLE 2

| Comparison of Treated and Non-Treated Soluble Extracts | | | | | | |
|---|---|---|---|---|---|---|
| | Tobacco Soluble Extracts | | | | | |
| Sample | Humidity (%) | NNN (ppb) | NNK (ppb) | NAT (ppb) | NAB (ppb) | Total TSNA (ppb) |
| Control Soluble Extracts Fraction | 91.1 | 565.5 | 208.5 | 298.5 | 18.1 | 1091 |
| Treated Soluble Extracts Fraction by Sepiolite Pangel ® FF | 91.6 | 198 | 1.5 | 279 | 17.5 | 495 |

| | Dry Matter | | | |
|---|---|---|---|---|
| Sample | Nitrates (%) | Nitrites (ppm) | Alkaloids (%) | Reducing Substances (ie., Sugar)(%) |
| Control Soluble Extracts Fraction | 6.93 | 552 | 1.30 | 15 |
| Treated Soluble Extracts Fraction by Sepiolite Pangel ® FF | 7.35 | 516 | 1.17 | 15.4 |

Example 3

The ability of sepiolite Pangel® FF and an alkali extractant (KOH) to reduce the presence of tobacco-specific nitrosamines in a soluble extracts fraction and insoluble residue fraction was demonstrated.

One control sample for comparative analysis was prepared. Four additional samples were prepared wherein the tobacco insoluble residue fraction was treated, the tobacco soluble extracts fraction was treated, the final tobacco product was treated, or a combination thereof.

LP1382 T: Control sample for comparative analysis without any treatment.

LP1382 A: The tobacco insoluble residue fraction was treated with 0.1N KOH and was thereafter impregnated with non-treated tobacco soluble extracts fraction.

LP1382 B: The tobacco soluble extracts fraction was treated with sepiolite Pangel® FF and was thereafter impregnated into a non-treated tobacco insoluble residue fraction.

LP1382 C: The tobacco soluble extracts fraction was treated with sepiolite Pangel® FF and was thereafter impregnated into a tobacco insoluble residue fraction treated with 0.1 N KOH.

LP1382 D: The tobacco soluble extracts fraction was treated with sepiolite Pangel® FF and was thereafter impregnated into a tobacco insoluble residue fraction treated with 0.1 N KOH. The subsequent product was treated with ascorbic acid.

For the tobacco insoluble residue fraction treatment, 300 grams of the base web or pulp was treated by contacting with 10 liters of a 0.1 N KOH solution for a duration of 1 hour. Thereafter, the base web or pulp was rinsed with a 0.5% acetic acid solution and water.

For the tobacco soluble extracts fraction treatment, the sepiolite Pangel® FF was contacted with the soluble extracts at a sepiolite concentration of 27.6 g/L.

For the final product treatment, a 250 g/L ascorbic acid spray solution was applied to the product. The amount of ascorbic acid added was equivalent to 20% by weight of the final reconstituted tobacco product.

The tobacco insoluble residue treatment, tobacco soluble extracts treatment, and final product treatment for each sample is shown below in Table 3.

TABLE 3

| Sample Treatments | | | |
|---|---|---|---|
| Sample | Tobacco Insoluble Residue Treatment | Tobacco Soluble Extracts Treatment | Final Product Treatment |
| LP1382 T | Without KOH | Without Pangel ® FF | Without |
| LP1382 A | KOH 0.1N | Without Pangel ® FF | Without |
| LP1382 B | Without KOH | Pangel ® FF (27.6 g/L) | Without |
| LP1382 C | KOH 0.1N | Pangel ® FF (276 g/L) | Without |
| LP1382 D | KOH 0.1N | Pangel ® FF (27.6 g/L) | Ascorbic Acid Spraying |

A reconstituted tobacco product was produced by recombining the insoluble residue fraction and soluble extracts fraction for samples LP1382 T, LP 1382 A, LP1382 B, LP1382 C, LP1382 D.

The hand-made cigarettes were made using LTR tubes with the same tobacco weight. The tobacco weight was 900 milligrams. The cigarettes were smoked on a Borgwaldt RM20 smoking machine. The results (including TSNAs) were analyzed by a Health Canada Intense smoking regime. Carbonyls were analyzed with an ISO smoking regime. The smoking of cigarettes was carried out on either a rotary smoking machine or a linear smoking machine depending on the compound to be analyzed. An analysis of the smoke for each of the samples is given in the tables below.

The analysis for the four treated samples in comparison to the control sample is shown in Tables 4, 5, and 6. Table 4 provides the results for the puff number and the total particulate matter, tar, nicotine, water, and carbon monoxide content of the tobacco product. Table 5 provides the results for the content of tobacco-specific nitrosamines in the smoke per tobacco product, such as a cigarette. Table 6 provides the results for the content of tobacco-specific nitrosamines in the smoke per mg of nicotine. (A+notation indicates an increase in the trial versus the control while a—notation indicates a decrease in the trial versus the control.)

TABLE 4

Comparison of Cigarette Characteristics of a Trial Sample Versus a Control Sample.

| | LP1382 A vs. LP1382 T (%) | LP1382 B vs. LP1382 T (%) | LP1382 C vs. LP1382 T (%) | LP1382 D vs. LP1382 T (%) |
|---|---|---|---|---|
| Puff Number | 7.04 | 4.23 | 5.63 | 8.45 |
| Total Particulate Matter (mg/cigarette) | 4.24 | −1.27 | 1.27 | 6.78 |
| Tar (mg/cigarette) | 7.38 | −2.68 | 1.34 | 4.03 |
| Nicotine (mg/cigarette) | −5.41 | −10.81 | −2.70 | −5.41 |
| Water (mg/cigarette) | −1.20 | 2.41 | 1.20 | 12.05 |
| Carbon Monoxide (mg/cigarette) | −0.66 | 0.33 | −1.32 | 2.98 |

TABLE 5

Comparison of TSNAs per Cigarette Product in a Trial Sample Versus a Control Sample.

| | | LP1382 A vs. LP1382 T (%) | LP1382 B vs. LP1382 T (%) | LP1382 C vs. LP1382 T (%) | LP1382 D vs. LP1382 T (%) |
|---|---|---|---|---|---|
| TSNAs (%/product based on ng TSNAs/ product) | NNN | −39.48 | −39.30 | −68.86 | −68.05 |
| | NNK | −32.39 | −11.66 | −47.00 | −29.68 |
| | NAT | −51.76 | −16.79 | −62.65 | −59.09 |
| | NAB | −27.11 | −9.15 | −25.00 | −40.85 |
| | Total TSNA | −38.45 | −20.81 | −56.19 | −47.48 |

TABLE 6

Comparison of TSNAs per mg of Nicotine in a Trial Sample Versus a Control Sample.

| | | LP1382 A vs. LP1382 T (%) | LP1382 B vs. LP1382 T (%) | LP1382 C vs. LP1382 T (%) | LP1382 D vs. LP1382 T (%) |
|---|---|---|---|---|---|
| TSNAs (%/mg nicotine based on ng TSNAs/ mg nicotine) | NNN | −36.02 | −31.94 | −68.00 | −66.22 |
| | NNK | −28.52 | −0.95 | −45.53 | −25.66 |
| | NAT | −49.00 | −6.71 | −61.61 | −56.75 |
| | NAB | −22.95 | 1.86 | −22.92 | −37.46 |
| | Total TSNA | −34.93 | −11.21 | −54.97 | −44.48 |

Example 4

The ability of sepiolite Pangel® FF and an alkali extractant (KOH) to reduce the presence of tobacco-specific nitrosamines in a soluble extracts fraction and insoluble residue fraction was demonstrated. In addition, the effect of the method on other Hoffmann analytes is also demonstrated.

One control sample for comparative analysis was prepared. One additional sample was prepared wherein the tobacco insoluble residue fraction was treated and the tobacco soluble extracts fraction was treated.

LP1421 T: Control sample for comparative analysis without any treatment.

LP1421 A: The tobacco soluble extracts fraction was treated with sepiolite Pangel® FF and was thereafter impregnated into a tobacco insoluble residue fraction treated with 0.1N KOH.

For the tobacco insoluble residue fraction treatment, 300 grams of the base web or pulp was treated by contacting with 10 liters of a 0.1N KOH solution for a duration of 1 hour. Thereafter, the base web or pulp was rinsed with a 0.5% acetic acid solution and water.

For the tobacco soluble extracts fraction treatment, the sepiolite Pangel® FF was contacted with the soluble extracts at a sepiolite concentration of 27.6 g/L.

A reconstituted tobacco product was produced by recombining the insoluble residue fraction and soluble extracts fraction for samples LP1421 T and LP1421 A.

The hand-made cigarettes were made using LTR tubes with the same tobacco weight. The tobacco weight was 1000 milligrams. The cigarettes were smoked on a Borgwaldt RM20 smoking machine. Carbonyls were analyzed with an ISO smoking regime. The other results (including TSNAs) were analyzed by a Health Canada Intense smoking regime. The smoking of cigarettes was carried out on either a rotary smoking machine or a linear smoking machine depending on the compound to be analyzed. An analysis of the smoke for each of the samples is given in the table below.

Table 7 provides the results for the emissions of tobacco-specific nitrosamines and other Hoffman analytes in the smoke per cigarette. (A—notation indicates a decrease in the trial versus the control.)

TABLE 7

Comparison of TSNAs and Hoffman Analytes in a Trial Sample Versus a Control Sample.

| | | LP1421 T | LP1421 A | % Difference in Trial vs. Control |
|---|---|---|---|---|
| | Tar (mg/cigarette) | 17.7 | 17 | −4 |
| | Nicotine (mg/cigarette) | 0.46 | 0.41 | −11 |
| | CO (mg/cigarette) | 32.8 | 32.6 | −1 |
| | CO/Tar | 1.86 | 1.92 | 3 |
| | Ammonia (μg/cigarette) | 18.3 | 17.6 | −4 |
| TSNAs | NNN (ng/cigarette) | 121.8 | 52.1 | −57 |
| | NNK (ng/cigarette) | 325.3 | 188.8 | −42 |
| | NAT(ng/cigarette) | 76.8 | 58.6 | −24 |
| | NAB (ng/cigarette) | 20.4 | 18.8 | −8 |
| | Total TSNAs (ng/cigarette) | 544.3 | 318.3 | −42 |
| Carbonyls | Acetaldehyde (μg/cigarette) | 909.6 | 934.3 | 3 |
| | Acetone (μg/cigarette) | 318.1 | 320.1 | 1 |
| | Crotonaldehyde (μg/cigarette) | 28.3 | 29.4 | 4 |
| Volatiles | Isoprene (μg/cigarette) | 83.4 | 85.6 | 3 |
| | Acrylonitrile (μg/cigarette) | 20.4 | 20.3 | 0 |
| | Benzene (μg/cigarette) | 73.1 | 75.3 | 3 |
| | Toluene (μg/cigarette) | 127.0 | 125.0 | −2 |
| | HCN (μg/cigarette) | 217.0 | 168.0 | −23 |
| | Pyridine (μg/cigarette) | 27.3 | 26.4 | −3 |
| | Quinoline (μg/cigarette) | 0.4 | 0.3 | −13 |
| | Hydroquinone (μg/cigarette) | 68.7 | 62.7 | −9 |
| | Catechol (μg/cigarette) | 99.2 | 98.9 | 0 |
| | Phenol (μg/cigarette) | 16.1 | 15.4 | −4 |
| | m + p cresols (μg/cigarette) | 11.9 | 11.2 | −6 |
| | o cresol (μg/cigarette) | 7.5 | 7.3 | −2 |
| Aromatic amines | 3-Amino biphenyl (ng/cigarette) | 4.3 | 4.3 | 0 |
| | 4-Amino biphenyl (ng/cigarette) | 3.4 | 3.1 | −10 |
| | 1-Aminonaphthalene (ng/cigarette) | 19.2 | 17.5 | −9 |
| | 2-Aminonaphthalene (ng/cigarette) | 13.7 | 13.6 | −1 |

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part.

Furthermore, those of ordinary skill in the art will appreciate that the foregoing description is by way of example only, and is not intended to limit the invention so further described in such appended claims.

The invention claimed is:

1. A method for reducing the content of nitrosamines in tobacco, the method comprising:

providing a tobacco having an initial level of tobacco-specific nitrosamines;

combining the tobacco with an aqueous solvent to form a soluble extracts fraction having an initial level of tobacco-specific nitrosamines and an insoluble residue fraction having an initial level of tobacco-specific nitrosamines;

contacting the soluble extracts fraction with a nitrosamine-reducing material having a specific surface area of from greater than 240 $m^2/g$; to about 300 $m^2/g$ to form a soluble extracts fraction having a reduced level of tobacco-specific nitrosamines;

contacting the insoluble residue fraction with an alkali extractant to form an insoluble residue fraction having a reduced level of tobacco-specific nitrosamines; and optionally, recombining the soluble extracts fraction having a reduced level of tobacco-specific nitrosamines and the insoluble residue fraction having a reduced level of tobacco-specific nitrosamines to form a reconstituted tobacco product, wherein the reconstituted tobacco product has a final level of tobacco-specific nitrosamines, the final level being at least 30% less than a tobacco product not treated with a nitrosamine-reducing material and an alkali extractant.

2. The method as defined in claim 1, wherein the nitrosamine-reducing material is comprises a sepiolite and the alkali extractant comprises potassium hydroxide.

3. The method as defined in claim 1, further comprising treating the reconstituted tobacco product with ascorbic acid, a mineral ascorbate, or a combination thereof.

4. The method as defined in claim 3, wherein after treating the reconstituted tobacco product, the reconstituted tobacco product comprises from about 15weight % to about 30 weight % of the ascorbic acid, a mineral ascorbate, or a combination thereof.

5. The method as defined in claim 1, wherein the nitrosamine-reducing material is selected from the group consisting of charcoal, activated charcoal, zeolite, sepiolite, and combinations thereof.

6. The method as defined in claim 1, wherein the nitrosamine-reducing material is a sepiolite having the following formula:

$$Si_{12}Mg_8O_{30}(OH)_4 \cdot 12H_2O.$$

7. The method as defined in claim 1, wherein the nitrosamine-reducing material is a sepiolite with a specific surface area that is of from about 260 $m^2/g$ to about 300 $m^2/g$.

8. The method as defined in claim 1, wherein the nitrosamine-reducing material is mixed with the soluble extracts fraction and removed from the soluble extracts fraction after being mixed therewith.

9. The method as defined in claim 1, wherein the soluble extracts fraction is filtered or conveyed through the nitrosamine-reducing material.

10. The method as defined in claim 1, further comprising separating the insoluble extracts fraction formed from combining the aqueous solvent with the tobacco from the soluble extracts fraction prior to contacting the soluble extracts fraction with the nitrosamine-reducing material.

11. The method as defined in claim 1, wherein the alkali extractant is selected from the group consisting of potassium hydroxide, sodium hydroxide, a phosphate salt, a carbonate salt, and a combination thereof.

12. The method as defined in claim 1, wherein the alkali extractant consists of potassium hydroxide.

13. The method as defined in claim 1, wherein the alkali extractant comprises potassium hydroxide.

14. The method as defined in claim 1, wherein the alkali extractant is mixed with the insoluble residue fraction and removed from the insoluble residue fraction after being mixed therewith.

15. The method as defined in claim 1, further comprising washing the insoluble residue fraction having a reduced level of tobacco-specific nitrosamines with an acetic acid solution.

16. The method as defined in claim 1, wherein the final level of tobacco-specific nitrosamines is at least 40% less than a reconstituted tobacco product not treated with a nitrosamine-reducing material and an alkali extractant.

17. A method for reducing the tobacco-specific nitrosamines comprising:

providing a tobacco with an initial level of tobacco-specific nitrosamines;

combining the tobacco with an aqueous solvent to form a soluble extracts fraction and an insoluble residue fraction;

contacting the soluble extracts fraction with a nitrosamine-reducing material to form a soluble extracts fraction having a reduced level of tobacco-specific nitrosamines, the nitrosamine-reducing material comprising a sepiolite having the formula $Si_{12}Mg_8O_{30}(OH)_4 \cdot 12H_2O$, the sepiolite having a specific surface area of from greater than 240 $m^2/g$ to 300 $m^2/g$ wherein less than 16% of the sepiolite particles have a particle size larger than about 44 μm;

optionally, contacting the insoluble residue fraction with an alkali extractant comprising potassium hydroxide to form an insoluble residue fraction having a reduced level of tobacco-specific nitrosamines; and optionally, recombining the soluble extracts fraction having a reduced level of tobacco-specific nitrosamines and the insoluble residue fraction having a reduced level of tobacco-specific nitrosamines to form a reconstituted tobacco product, wherein the reconstituted tobacco product has a final level of tobacco-specific nitrosamines, the final level being at least 30% less than a reconstituted tobacco product not treated with a nitrosamine-reducing material and optionally an alkali extractant.

18. The method as defined in claim 17, further comprising treating the reconstituted tobacco product with ascorbic acid, a mineral ascorbate, or a combination thereof, wherein after treating the reconstituted tobacco product, the reconstituted tobacco product comprises from about 15 weight % to about 30 weight % of the ascorbic acid, a mineral ascorbate, or a combination thereof.

19. The method as defined in claim 17, wherein the sepiolite is mixed with the soluble extracts fraction and is removed from the soluble extracts fraction after being mixed therewith.

20. The method as defined in claim 17, wherein the soluble extracts fraction is filtered or conveyed through the nitrosamine-reducing material.

21. The method as defined in claim 17, further comprising separating the insoluble extracts fraction formed from combining the aqueous solvent with the tobacco from the soluble extracts fraction prior to contacting the soluble extracts fraction with the nitrosamine-reducing material.

22. The method as defined in claim 17, wherein the alkali extractant consists of potassium hydroxide.

23. The method as defined in claim 17, wherein the alkali extractant is mixed with the insoluble residue fraction and removed from the insoluble residue fraction after being mixed therewith.

24. The method as defined in claim 17, further comprising washing the insoluble residue fraction having a reduced level of tobacco-specific nitrosamines with an acetic acid solution.

25. The method as defined in claim 17, wherein the final level of tobacco-specific nitrosamines is at least 40% less than a reconstituted tobacco product not treated with a nitrosamine-reducing material and optionally an alkali extractant.

26. The method as defined in claim 17, wherein the tobacco product is formed into a smoking article comprising a cigarette, a cigar, or a pipe.

27. The method as defined in claim 17, wherein the tobacco product is formed into chewing tobacco, snuff, or snus.

28. The method as defined in claim 5, wherein the sepiolite is provided as a clay composition comprising other clays, wherein the other clays comprise less than 30 wt. % of the composition.

29. The method as defined in claim 17, wherein the sepiolite is provided as a clay composition comprising other clays, wherein the other clays comprise less than 30 wt. % of the composition.

30. A method for reducing the tobacco-specific nitrosamines comprising:

providing a tobacco with an initial level of tobacco-specific nitrosamines;

combining the tobacco with an aqueous solvent to form a soluble extracts fraction having an initial level of tobacco-specific nitrosamines and an insoluble residue fraction having an initial level of tobacco-specific nitrosamines;

contacting the soluble extracts fraction with a nitrosamine-reducing material to form a soluble extracts fraction having a reduced level of tobacco-specific nitrosamines, the nitrosamine-reducing material comprising a clay composition comprising a sepiolite having the formula $Si_{12}Mg_8O_{30}(OH)_4 \cdot 12H_2O$ and other clays, the sepiolite having a specific surface area of from 260 $m^2/g$ to 300 $m^2/g$, wherein the composition comprises less than 30 wt.% of other clays, and wherein either (i) less than 16% of the sepiolite, particles have a particle size larger than about 44 μm or (ii) greater than 80% of the sepiolite particles have a particle size of less than about 5 μm;

contacting the insoluble residue fraction with an alkali extractant to form an insoluble residue fraction having a reduced level of tobacco-specific nitrosamines; and optionally, recombining the soluble extracts fraction having a reduced level of tobacco-specific nitrosamines and the insoluble residue fraction having a reduced level of tobacco-specific nitrosamines to form a reconstituted tobacco product, wherein the reconstituted tobacco product has a final level of tobacco-specific nitrosamines, the final level being at least 30% less than a reconstituted tobacco product not treated with a nitrosamine-reducing material and an alkali extractant.

31. The method as defined in claim 30, wherein the alkali extractant comprises potassium hydroxide.

32. The method as defined in claim 31, wherein the final level of tobacco-specific nitrosamines is at least 40% less than a reconstituted tobacco product not treated with a nitrosamine-reducing material and an alkali extractant.

* * * * *